US005581908A

United States Patent [19]

Theilacker

[11] Patent Number: 5,581,908

[45] Date of Patent: Dec. 10, 1996

[54] DEVICE FOR DRAWING IN MATERIAL WEBS THROUGH A DRIER WITH A GUIDE THAT CAN BE CLOSED-OFF

[75] Inventor: Klaus Theilacker, Friedberg, Germany

[73] Assignee: MAN Roland Druckmaschinen AG, Offenbach am Main, Germany

[21] Appl. No.: 281,846

[22] Filed: Jul. 28, 1994

[30] Foreign Application Priority Data

Jul. 28, 1993 [DE] Germany ..... 43 25 251.6

[51] Int. Cl.[6] ..... F26B 13/06; B65H 20/16; B65H 23/038

[52] U.S. Cl. ..... 34/634; 34/646; 226/17; 226/19; 226/92

[58] Field of Search ..... 226/91, 92, 45, 226/17, 21, 19; 101/228; 34/634, 646, 631

[56] References Cited

U.S. PATENT DOCUMENTS

| | | | |
|---|---|---|---|
| 2,574,083 | 11/1951 | Andrews | 34/646 |
| 4,272,851 | 6/1981 | Goldstein | 2/79 |
| 4,341,024 | 7/1982 | Witkin | 34/155 |
| 4,960,234 | 10/1990 | Focke | 226/15 |
| 5,108,022 | 4/1992 | Birkmair et al. | 226/15 X |
| 5,263,414 | 11/1993 | Lehrrieder et al. | 226/92 X |
| 5,400,940 | 3/1995 | Sato et al. | 226/92 |

FOREIGN PATENT DOCUMENTS

| | | |
|---|---|---|
| 038450 | 4/1981 | European Pat. Off. . |
| 0388866 | 9/1990 | European Pat. Off. . |
| 0425741 | 5/1991 | European Pat. Off. . |
| 1219498 | 6/1966 | Germany . |
| 1231981 | 1/1967 | Germany . |
| 3009019A1 | 9/1981 | Germany . |
| 968619 | 9/1964 | United Kingdom . |

*Primary Examiner*—John M. Jillions
*Attorney, Agent, or Firm*—Cohen, Pontani, Lieberman, Pavane

[57] ABSTRACT

Arrangements are described which allow a printing stock web to be reliably drawn through a drier. A draw-in member which grasps the tip of a printing stock web has a power transmission, e.g. a roller chain, which runs in a guide. Plates or blowing boxes which are movable vertically to the draw-in plane of the printing stock web and form closures in the guide by lateral projections of their side walls are provided to prevent dirt from penetrating into this guide. Rollers or cylinders are provided for additional correction of a lateral displacement of the printing stock web while the web is drawn in by the draw-in member. A friction-locking engagement, i.e., particularly rolling friction or adhesive friction, causes these rollers or cylinders either to exert a transverse traction on the printing stock web themselves or, in order to compensate for the lateral displacement of the printing stock web, secure the printing stock web in the correct position due to a transverse traction produced by an oppositely directed displacement of the guide.

15 Claims, 2 Drawing Sheets

DEVICE FOR DRAWING IN MATERIAL WEBS THROUGH A DRIER WITH A GUIDE THAT CAN BE CLOSED-OFF

BACKGROUND OF THE INVENTION

1. Field of the Invention

The invention is directed to a device for drawing in material webs, preferably paper webs, through a drier which is arranged downstream of a web-fed rotary printing machine. The web is drawn by means of a draw-in member comprising a draw-in tip and a power transmission for transmitting force from a drive to the draw-in tip and from the draw tip to the start of the material web, wherein the power transmission runs inside a guide.

2. Description of the Prior Art

Driers in which the material web, i.e. a printing stock web, in particular a web of paper, is dried are often arranged downstream of web-fed rotary printing presses. At temperatures of up to 300° C., the volatile components of the printing inks evaporate. A drier of this type in which hot air is blown out of an oven via chambers and pipes against the printing stock web from both sides is known from U.S. Pat. No. 4,341,024.

On the other hand, it is already known to reintroduce a printing stock web into a web-fed rotary printing machine by means of a draw-in device. It is likewise already known to draw the printing stock web not only through the printing machine, but also through a drier arranged downstream thereof. The draw-in device has a draw-in member for drawing in the printing stock web. The draw-in member has a power transmission and a draw-in tip fastened thereto, to which tip the start of the printing stock web is fastened. The power transmission, e.g. a cable or roller chain, is acted upon by drive means, e.g. a driving wheel, via frictional engagement (a cable) or positive engagement (a roller chain) and transmits this force to the draw-in tip. When the power transmission runs through the guide and also through the drier, the following problem arises. After the power transmission has been withdrawn from the guide at the conclusion of the drawing in process and the printing machine is put into operation and while the printing stock web carrying wet printing ink is being dried in the drier, the guide located in the drier is soiled by condensing components of the volatile substances of the printing ink and becomes clogged. In view of this, the power transmission can no longer be relied upon in every case to draw a new web of printing stock into the guide. The power transmission is either substantially slowed down by dirt and thus exposed to a high level of wear or it can no longer be moved in the guide at all.

SUMMARY OF THE INVENTION

Accordingly, it is an object of the present invention to enable a reliable drawing in of the printing stock web through the drier.

Pursuant to this object, and others which will become apparent hereafter, one aspect of the present invention resides in a device for drawing in a printing stock web in a movement direction through a drier arranged downstream of a web-fed rotary printing machine. The device includes a draw-in member having a draw-in tip, and a power transmission for transmitting a driving force to the draw-in tip and from the draw-in tip to the start of a printing stock web. The power transmission runs inside a guide that is open toward the side of the printing stock web only while the draw-in member is drawing in the printing stock web. The guide is closed on this side at the conclusion of drawing in of the web by closing means so that the guide is closed in the longitudinal direction along its entire circumference.

In addition to the problem of dirt penetrating into the guide of the power transmission of the draw-in member, the length of the drier presents a further difficulty in drawing in a new printing stock web. Not only does the draw-in member exert a tractive force on the printing stock web via the draw-in tip in the longitudinal direction of the printing stock web, it also exerts lateral traction. Accordingly, the start of the printing stock web is deflected laterally, particularly if it is pulled freely over a great length. In order to correct this lateral displacement, a further embodiment of the invention provides for two rollers which are arranged one above the other and press against the printing stock web from the top and bottom. The rollers are arranged at an obtuse angle, e.g. between 80° and 90°, relative to the desired running direction of the printing stock web in order to compensate for the lateral displacement of the printing stock web. After running between these two rollers, the printing stock web is pulled straight again.

When two cylinders which do not contact one another are arranged downstream of the drier and the printing stock web runs between them in an S-shaped manner, e.g. so as to loop around each of the two rollers along half of their circumference, the lateral distance of the guide of the power transmission from the normal path provided for the printing stock web in the region in which the printing stock web is freely suspended between the two rollers can be brought correspondingly closer to the center of the cylinders in order to compensate for the lateral displacement of the printing stock web from the intended path so that, as soon as it loops around the second roller, the printing stock web already runs on the correct draw-in path again. This arrangement can be used in a particularly advantageous manner when a cooling mechanism already containing cooling rolls is arranged downstream of the drier, and a corresponding path for the guide for the power transmission can be provided between these cooling rolls.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 2A:
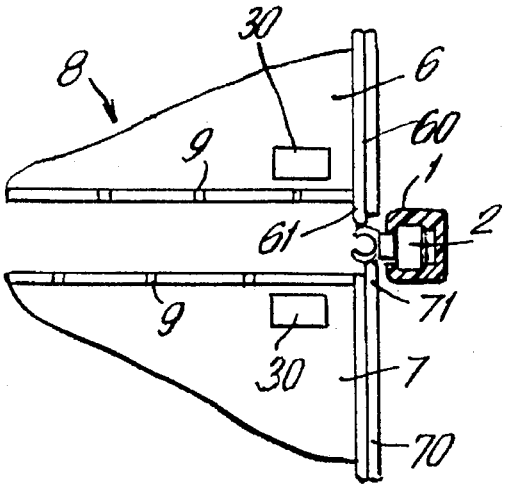
FIGS. 2 *a–b* show cross-sectional views of the guide in a drier outfitted with blowing boxes.
Figure 2B:
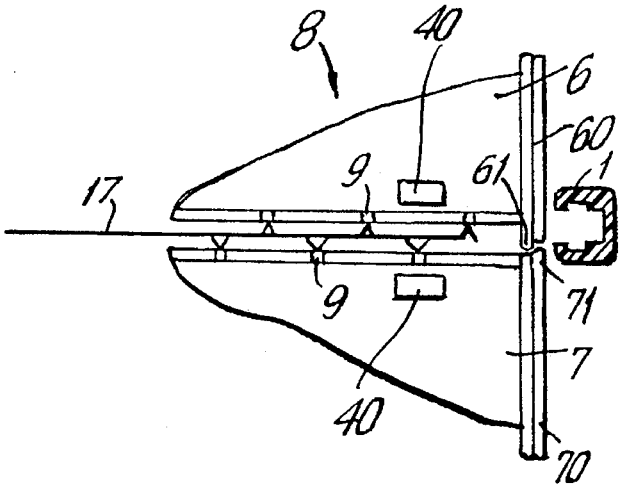
Figure 3A:
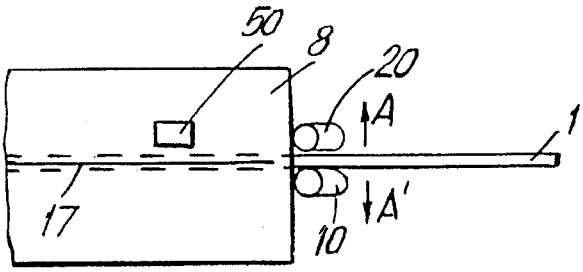
FIGS. 3 *a–c* show longitudinal sections and a top view, respectively, of an arrangement with two rollers for adjusting the material web.
Figure 3C:
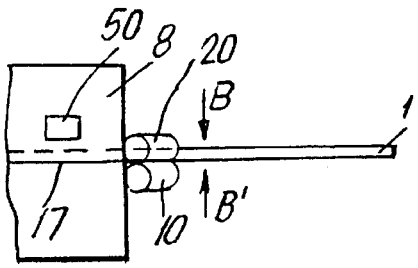
Figure 3B:
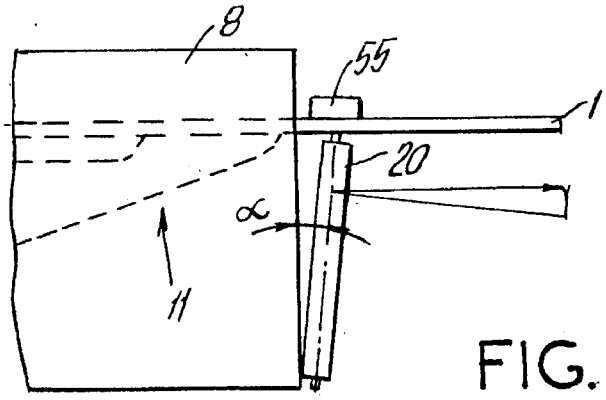

A material web, e.g., a printing stock web 17 (FIG. 2*b*), in particular a paper web, is drawn into a machine for processing the material web by means of a draw-in member 11 (FIG. 3*b*).

Figure 1A:
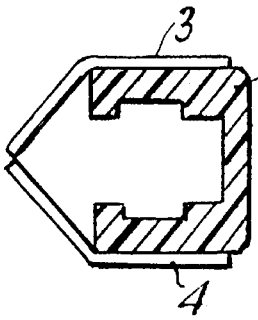
FIGS. 1 *a–d* show cross-sectional views of the guide for the power transmission in the region of the drier.

A paper web is drawn into a web-fed rotary printing machine, for instance. The draw-in member 11 includes a draw-in tip and a power transmission for a positive-locking or friction-locking transmission of force from the driving wheels in drive stations to the draw-in tip and accordingly to the paper web. The power transmission is either a cable or a roller chain 2 (FIG. 1*b*) or the like. The roller chain 2 is driven, for example, in drive stations via driving wheels constructed as toothed wheels. The roller chain 2 runs in a guide 1 (FIGS. 1*a, b*) which is arranged alongside the path of the printing stock web 17. The guide 1 (FIG. 1*a*) for the roller chain 2 (FIGS. 1*b*, 1*d*) has a substantially rectangular cross section and opens toward the side of the printing stock web 17.

In the region of a drier 8 (FIGS. 2*a*, 2*b*) arranged downstream of the web-fed rotary printing machine, the guide 1 for the roller chain 2 is, according to the invention, open only during the drawing in process. During the remaining time, i.e. while the printing stock web 17 which is already printed upon is being drawn through the drier 8 and while the volatile components of the printing ink are being removed from the printing stock web 17 by heating, the guide 1 is closed by means of plates 3, 4 (FIG. 1*a*) so that the guide 1 is not soiled by components which are condensing again. The plates 3, 4 form the closing means which prevents clogging of the guide 1. The plates 3, 4 can be drawn away from the guide 1 at the top or bottom, or are constructed to be resilient so that they are bent away toward the side, as shown in FIG. 1*b*, when the draw-in member 11 (FIG. 3*b*) and roller chain 2 connected thereto are drawn through. In another embodiment, the closing of the plates 3, 4 is ensured by electrical attracting means 30 or magnetic attracting means 40 for attracting the plates 3, 4.

Figure 1C:
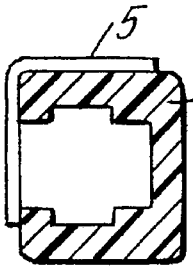
Figure 1B:
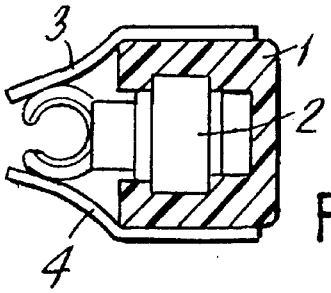
Figure 1D:
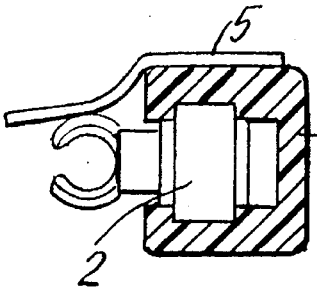

FIG. 1*c* shows a plate 5 which is constructed as an angle and is fastened to the upper side of the guide 1. It is also resilient and is bent upward when the roller chain 2 is drawn through (FIG. 1*d*). It is also possible for the plates 5 to be fastened to hinges so that they are swivelable and are pushed up when the roller chain 2 runs through. When the roller chain 2 runs through the drier 8, the plates 5 fall down again due to their own weight.

The lateral closure of the guide 1 is not necessarily mechanically connected with the guide 1 itself. Since in many driers the hot air is fed through blowing boxes with openings facing the printing stock web, an embodiment of the invention is provided with blowing boxes 6 and 7 which are arranged above and below the path of the printing stock web 8 (FIG. 2*b*), hot air being blown on the printing stock web 17 through openings 9 in the blowing boxes 6, 7. The blowing boxes 6 and 7 have a lower and an upper projection or overlap 61, 71 at their side walls 60, 70. The blowing boxes 6, 7 are spread apart during the drawing in process (FIG. 2*a*) so that the draw-in member 11 can be guided through between them.

However, while the printing stock web 17 (FIG. 2*b*) which is already printed and undergoing drying in the drier 8 is being pulled through the drier 8, the blowing boxes 6, 7 are moved together until their projections 61, 71 engage one inside the other. In this way, they simultaneously form a closure relative to the guide 1 which is accordingly protected from the oil-containing steam.

A problem occurring when the printing stock web 17 is drawn in through the drier 8 is that the start of the printing stock web 17 does not run only on the desired draw-in path in the longitudinal direction, but is also pulled transversely to the longitudinal direction. As a result of this lateral pulling, the draw-in member 11 runs in only one guide 1 on one longitudinal side of the printing stock web 17 and does not engage the start of the printing stock web 17 in its center. Accordingly, the printing stock web 17, which is pulled along a considerably long distance in a freely suspended manner, i.e. without being supported by guide rollers, as is the case in the drier 8, for example, is displaced laterally by several centimeters when freely suspended over several meters.

In order to compensate for such displacement, cylinders 20 and 10 are movably supported downstream of the drier 8 above and below the movement path of the printing stock web 17 vertically to the running direction of the printing stock web 17 as is indicated by arrows A, A'. A preferably mechanical, electrical or optical sensor 50 is arranged in the vicinity of the cylinders 20, 10, e.g. in the region of the guide 1, and senses when a draw-in member 11 (FIG. 3*b*) runs through the drier 8 and between the cylinders 20 and 10. The cylinders 20, 10 (FIG. 3*c*) are then moved in the direction of arrows B, B' toward the printing stock web 17 until they contact the latter and exert a lateral traction on the printing stock web 17 because of the rolling friction resulting from their oblique position (FIG. 3*b*), e.g. at 10° (angle $\alpha$), with reference to the transverse direction of the printing stock web. The printing stock web 17 is accordingly realigned so that it again runs parallel to the guide 1. After this alignment, the cylinders move back into their initial position so that the printing stock web 17 is not contacted as the production run continues.

The rollers 20, 10 can also be supported so that the angle $\alpha$ (FIG. 3*b*), and accordingly the transverse component which can be exerted on the printing stock web by the rollers 20, 10, can be changed by appropriate means 55. When a sensor, e.g. all optical sensor, registers the lateral displacement of the printing stock web 17, the position of the rollers 20, 10 can be controlled, for example, so that the rollers 20, 10 exert a lateral pull on the printing stock web 17 so as to compensate precisely for the tractive force exerted by the draw-in member 11.

Figure 4A:
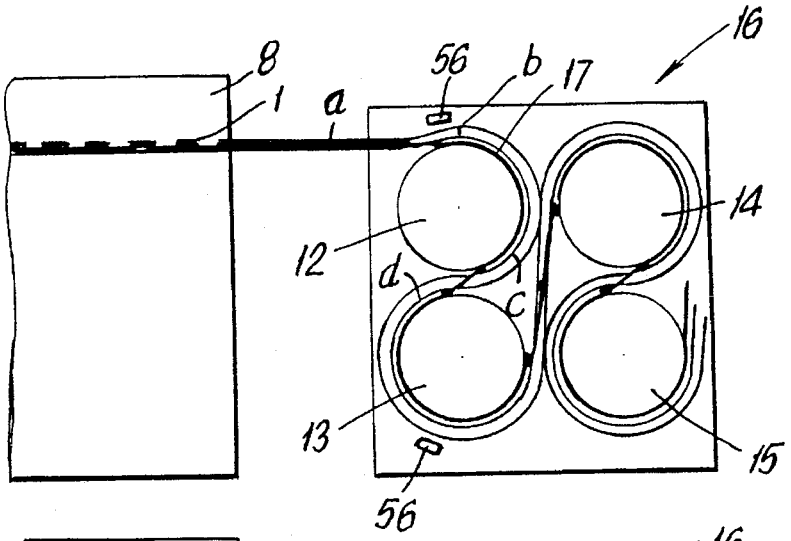
FIGS. 4 *a–b* show another arrangement with rollers and with a curved part of the guide for adjusting the position of the material web.
Figure 4B:
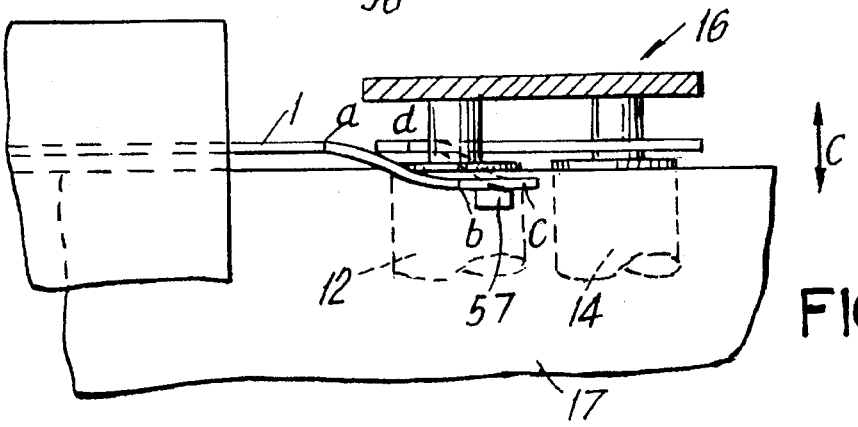

In another construction of a device for compensating for the transverse deviation of the printing stock web 17, a plurality of cylinders or rollers 12, 13 (FIG. 4*a*) which are supported so as to be stationary, for example, are arranged downstream of the drier 8. The printing stock web 17 preferably runs in an S-shaped manner between these rollers 12, 13. Due to the S-shaped course, the printing stock web 17 loops around half of the circumference of the rollers 12, 13 in each instance. The adhesive friction between the rollers 12, 13 on the one hand and the printing stock web 17 on the other hand holds the printing stock web 17 on the circumferential surface. For this reason, the lateral deviation of the printing stock web 17 from the desired position or reference position must be corrected before the web comes into contact with the cylinders 12, 13. Therefore, the guide 1 diverges in its vertical position from the path of the printing stock web 17 after point a (FIG. 4*a*) until point d so that it can be offset from the center of the machine at the same time until point c (FIG. 4*b*) without contacting or damaging the printing stock web 17. As soon as a sufficient adhesive friction has been generated because of the looping of the draw-in tip around the cylinder 12, the guide 1 can return to the position close to the side wall after point c (FIGS. 4*a*/4*b*), which must be effected at point d (FIGS. 4*a*/4*b*) since the guide 1 and the printing stock web 17 would otherwise contact or interfere with one another when the paths intersect. Due to the adhesive friction between the cylinder 12 and the printing stock web 17 and due to the aligning effect exerted on the web when looping around a cylinder, the printing stock web 17 remains in its center position in spite of the one-sided traction exerted by the roller chain 2. The cylinders 12, 13 are combined with other cylinders 14, 15 (FIG. 4*a*), e.g. cooling rolls, and are part of a cooling mechanism 16.

As is the case with the cylinders 20, 10, it is also possible with the cylinders 12, 13 to detect the lateral deviation of the printing stock web 17 from the desired central course along the rollers and cylinders at certain points in the vicinity of the cylinders 12, 13 by means of optical, electronic or mechanical detectors 56 so that this deviation may be corrected subsequently by means of the guide 1 in position (c). For this purpose, the guide 1 must be constructed so as to be movable at position (c) appropriate means 57.

The guide 1 can then be adjusted in the region of the S-shaped loop of the printing stock web 17 between the rollers 12 and 13 in the direction of arrow C (FIG. 4*b*) in order to correct the printing stock web 17 laterally exactly by the deviation measured by the detector or detectors.

According to the invention, arrangements are provided which allow a printing stock web 17 to be drawn through a drier 8 in a reliable manner. A draw-in member 11 which grasps the tip of a printing stock web 17 has a power transmission, e.g. a roller chain 2, which runs in a guide 1. In order to prevent dirt from penetrating into this guide 1, plates 3, 4, 5 or blowing boxes 6, 7 which are movable vertically to the draw-in plane of the printing stock web form closures in the guide 1 by means of lateral projections 61, 71 of their side walls 60, 70. Cylinders 20, 10 or rollers 12, 13 are provided for additional correction of a lateral displacement of the printing stock web while the latter is drawn in by the draw-in member. By means of a friction-locking engagement, i.e., particularly by means of rolling friction or adhesive friction, these cylinders 20, 10 or rollers 12, 13 either exert a transverse traction on the printing stock web 17 themselves or, in order to compensate for the lateral displacement of the printing stock web 17, secure the printing stock web 17 in the correct position by means of a transverse traction produced by an oppositely directed displacement of the guide 1.

The arrangement of cylinders 12, 13, 14, 15 is particularly suitable for use in a device according to FIG. 1, but it can be advantageously arranged downstream of any drier through which the printing stock web 17 is automatically drawn in.

The invention is not limited by the embodiments described above which are presented as examples only but can be modified in various ways within the scope of protection defined by the appended patent claims.

I claim:

1. A device for drawing in a printing stock web in a movement direction through a drier arranged downstream of a web-fed rotary printing machine, comprising: a draw-in member having a draw-in tip; power transmission means for engaging and transmitting a driving force to the draw-in tip and from the draw-in tip to a start of the printing stock web; a guide member having a longitudinally running opening in which the power transmission means runs; and means for closing-off the opening of the guide in the longitudinal direction when the draw-in member is not drawing in the printing stock web, the closing-off means being movable to maintain the opening open toward a side of the printing stock web only while the draw-in member is drawing-in the web.

2. A device according to claim 1, wherein the closing-off means includes plates.

3. A device according to claim 2, wherein the plates are resilient and are attached to the guide so as to cover the opening.

4. A device according to claim 2, wherein the plates close the opening by gravity due to weight.

5. A device according to claim 2, wherein the closing-off means includes spring means for closing the plates over the opening in the guide.

6. A device according to claim 2, wherein the closing-off means includes means for electrically attracting the plates to close the opening in the guide.

7. A device according to claim 2, wherein the closing-off means includes means for magnetically attracting the plates to close the opening in the guide.

8. A device according to claim 1, and further comprising blowing boxes arranged in the drier so as to be adjacent and parallel to the guide member and so as to face one another and to be movable substantially vertically to the movement direction of the printing stock web, the blowing boxes having side walls with projections, and means for mounting the blowing boxes for movement between a first position in which the side walls are pulled away from one another during drawing in of the web and a second position in which the projections of the side walls engage to close-off the guide from exposure to the web at a conclusion of the drawing-in of the web.

9. A device according to claim 1, and further comprising two first cylinders arranged downstream of the drier and so as to press against one another and so as to grasp the printing stock web at an oblique angle and pull it away from the guide during the drawing in to correct any lateral deviation of the printing stock web from its intended path caused by lateral pulling of the draw-in member in a direction of the guide.

10. A device according to claim 9, and further comprising sensor means associated with the first cylinders for measuring lateral displacement of the printing stock web, and means for adjusting the angle of the first cylinders relative to the printing stock web based upon measurements of the measuring means so that the printing stock web can be drawn by the first cylinders toward a center of the intended path by a tractive force equal to and directed opposite to the lateral tractive force of the draw-in member.

11. A device according to claim 1, wherein the guide is movable, and further comprising means for moving the guide, and at least two cylinders arranged downstream of the drier so as not to contact one another, the printing stock web being guided between the at least two cylinders in an S-shaped manner after passing through the drier and the web being displaced laterally as the guide is moved closer to the center of the cylinders, the printing stock web being held on a circumferential surface of the at least two cylinders by friction created by looping around the cylinders so that the at least two cylinders exert a transverse traction on the printing stock web to correct the lateral displacement of the printing stock web caused by oppositely directed lateral traction exerted by the draw-in member in a direction of the guide.

12. A device according to claim 11, and further comprising sensor means associated with the at least two cylinders for sensing the lateral displacement of the printing stock web, the guide being displaceable in a region between the at least two cylinders, depending on the lateral displacement of the printing stock web, toward the center of the cylinders so that the printing stock web is drawn toward the center of an intended path by a tractive force equal to and directed opposite to the lateral tractive force of the draw-in member, and means for displacing the guide.

13. A device according to claim 1, wherein the power transmission means is a chain.

14. A device according to claim 1, wherein the power transmission means is a cable.

15. A device for drawing in a printing stock web through a drier arranged downstream of a web-fed rotary printing machine, the device comprising at least two cylinders arranged downstream of the drier so as not to contact one another; a draw-in member having a draw-in tip; power transmission means for transmitting a driving force to the draw-in tip and from the draw-in tip to a start of the printing stock web; a guide member having a longitudinally running opening in which the power transmission means runs; and means for shifting the guide member toward the center of the at least two cylinders, the printing stock web being guided between the at least two cylinders in an S-shaped manner after passing through the drier and being laterally displaced as the guide is shifted closer to the center of the at least two cylinders along the path of the guide between the at least two cylinders, the printing stock web being held on a circumferential surface of the at least two cylinders by friction created by the web being looped around the cylinder so that the at least two cylinders exert a transverse traction on the printing stock web to correct the lateral displacement of the printing stock web caused by oppositely directed lateral traction exerted by the draw-in member in a direction of the guide.

* * * * *